US010355399B2

(12) United States Patent
Henzler

(10) Patent No.: US 10,355,399 B2
(45) Date of Patent: Jul. 16, 2019

(54) CABLE CONNECTOR HAVING A SHIELDING SLEEVE AND METHOD FOR PRODUCING THE SAME

(71) Applicant: ERNI Production GmbH & Co. KG, Adelberg (DE)

(72) Inventor: Magnus Henzler, Grossbettlingen (DE)

(73) Assignee: ERNI Production GmbH & Co. KG, Adelberg (DE)

( * ) Notice: Subject to any disclaimer, the term of this patent is extended or adjusted under 35 U.S.C. 154(b) by 0 days.

(21) Appl. No.: 15/754,648

(22) PCT Filed: Aug. 17, 2016

(86) PCT No.: PCT/DE2016/100370

§ 371 (c)(1),
(2) Date: Feb. 23, 2018

(87) PCT Pub. No.: WO2017/032359

PCT Pub. Date: Mar. 2, 2017

(65) Prior Publication Data

US 2018/0261955 A1 Sep. 13, 2018

(30) Foreign Application Priority Data

Aug. 24, 2015 (DE) ..... 10 2015 114 040

(51) Int. Cl.
*H01R 9/05* (2006.01)
*H01R 13/56* (2006.01)
(Continued)

(52) U.S. Cl.
CPC ..... *H01R 13/56* (2013.01); *H01R 9/032* (2013.01); *H01R 9/05* (2013.01); *H01R 13/506* (2013.01);
(Continued)

(58) Field of Classification Search
CPC .. H01R 13/56; H01R 13/506; H01R 13/5219; H01R 9/05; H01R 24/40; H01R 43/20
See application file for complete search history.

(56) References Cited

U.S. PATENT DOCUMENTS 5,322,453 A 6/1994 Resnick et al.
5,879,190 A 3/1999 Maruyama et al.
(Continued)

FOREIGN PATENT DOCUMENTS

DE 69618374 T2 7/2002
DE 102 29 700 C1 12/2003
(Continued)

OTHER PUBLICATIONS

International Search Report of PCT/DE2016/100370, dated Oct. 24, 2016.

*Primary Examiner* — Jean F Duverne
(74) *Attorney, Agent, or Firm* — Collard & Roe, P.C.

(57) ABSTRACT

The invention relates to a cable connector (6). It has a shielding sleeve (2) having a first portion with a first opening and having a second portion with a second opening which is angled relative to the first portion. The first portion furthermore has a third opening which is opposite the first opening on the longitudinal axis of the first portion. The second portion has a slot-shaped opening which connects the second opening to the third opening. A cable (3) is guided through the first opening and through the second opening of the shielding sleeve (2). The cable connector (6) can be produced by a first end of the cable (3) being introduced through the third opening into the first portion of the shielding sleeve (2) and then being guided out of this portion again through the first opening. The cable (3) is finally bent such that a part of the cable (3) is moved through the slot-shaped opening into the second portion of the shielding sleeve (2) and a second end of the cable (3) projects out of the second opening of the shielding sleeve (2).

10 Claims, 4 Drawing Sheets

(51) Int. Cl.

| | |
|---|---|
| ***H01R 9/03*** | (2006.01) |
| ***H01R 24/40*** | (2011.01) |
| ***H01R 43/20*** | (2006.01) |
| ***H01R 13/506*** | (2006.01) |
| *H01R 103/00* | (2006.01) |

(52) U.S. Cl.
CPC ..... *H01R 24/40* (2013.01); *H01R 43/20* (2013.01); *H01R 2103/00* (2013.01)

(56) References Cited

U.S. PATENT DOCUMENTS

| | | | | |
|---|---|---|---|---|
| 7,044,786 | B2 | 5/2006 | Nimura | |
| 7,507,125 | B2 * | 3/2009 | Okamura | H01R 13/506 439/680 |
| 7,641,504 | B1 | 1/2010 | Padruzzi | |
| 7,648,396 | B2 | 1/2010 | Nickol et al. | |
| 7,976,341 | B2 | 7/2011 | Osenberg | |
| 9,553,395 | B2 * | 1/2017 | Nagasaki | H01R 13/506 |
| 9,640,916 | B2 * | 5/2017 | Nakai | H01R 13/506 |
| 9,929,497 | B2 * | 3/2018 | Relue | H01R 13/5219 |

FOREIGN PATENT DOCUMENTS

| | | | |
|---|---|---|---|
| DE | 10 2004 019 027 | A1 | 12/2004 |
| DE | 10 2005 022 253 | A1 | 11/2006 |
| DE | 10 2006 012194 | A1 | 9/2007 |
| EP | 1 981 132 | B1 | 10/2008 |
| JP | 2008-192498 | A | 8/2008 |
| WO | 2008/061572 | A2 | 5/2008 |

* cited by examiner

CABLE CONNECTOR HAVING A SHIELDING SLEEVE AND METHOD FOR PRODUCING THE SAME

CROSS REFERENCE TO RELATED APPLICATIONS

This application is the National Stage of PCT/DE2016/100370 filed on Aug. 17, 2016, which claims priority under 35 U.S.C. § 119 of German Application No. 10 2015 114 040.3 filed on Aug. 24, 2015, the disclosure of which is incorporated by reference. The international application under PCT article 21(2) was not published in English.

The present invention relates to a cable connector which has a shielding sleeve, as well as a method for producing the cable connector.

PRIOR ART

It is occasionally necessary to shield electrical lines, for example lines in the high-frequency range. This is implemented by a cable shield. However, sometimes in cable connectors no cable shield can be arranged in the transition region between the cable and the connector. In order to nevertheless ensure electrical shielding, the cable is guided into this position by a metal shielding sleeve.

Assembled shielded cables can have both straight plugs and angle plugs. With straight shielded plugs it is simple to position a closed shielding sleeve over the cable and connect it to the plug part. To this end, for example, the shielding sleeve is slid over the cable in front of the contact connection by means of soldering, crimping or insulation displacement connectors and is pushed onto the insulating body of the connector and fastened after the contact connection.

With an angled shielded connector, a correspondingly angled shielding sleeve must be pulled over the cable, effectively around the corner, which is very difficult or impossible during assembly, in particular with thicker and thus stiffer cables. Furthermore, because of the forces occurring during handling, there is a permanent danger of these forces pulling on the contact connections, i.e. the solder points, crimp points or insulation displacement points, and damaging these.

A shielding sleeve in the form of a stamped part is known from EP 1 981 132 B1, which is first pulled over the cable and then must be bent into the corresponding end position after the cable connection. This subsequent bending of the shielding sleeve must be carried out by hand and to this end the cable must be bent and held in position.

DE 10 2005 022 253 A1 and WO 2008/061572 A2 each describe two-part designs of shielding sleeves which can be positioned over the insulating body of the cable connector after the connection. To this end, however, the cable must be bent and held in position and the two shield halves must be mounted simultaneously.

It is an object of the present invention to provide a cable connector in which a cable can be mounted in an angled position in a simple manner with a gentle contact connection. Furthermore, it is an object of the present invention to provide a method for producing such a cable connector.

Disclosure of the Invention

This object is solved in a first aspect of the invention by the cable connector according to the invention. This connector has a shielding sleeve having a first portion with a first opening and having a second portion with a second opening which is angled relative to the first portion. The first portion furthermore has a third opening, which is opposite the first opening on the longitudinal axis of the first portion. The second portion has a slot-shaped opening which connects the second opening to the third opening. The first portion of the shielding sleeve thus corresponds in its form to a conventional shielding sleeve for straight shielded connectors. Just as in these conventional straight shielding sleeves, it is possible to guide a cable through the two openings of the first portion in a simple manner without thereby bending it. The first portion with its first opening and the second portion with its second opening simultaneously form the shape of a shielding sleeve for an angled cable connector. As soon as a cable has been introduced into the first portion, it can be partially transferred into the second portion through the slot-shaped opening by means of bending and thus brought into an angled position in a simple manner. Furthermore, the cable connector has such a cable, which is guided through the first opening and through the second opening of the shielding sleeve. An angled arrangement of the cable in the cable connector is thus implemented, such that this can function as an angled shielded cable connector.

Unlike with two-part shielding sleeves, a simple assembly can be enabled by the first portion and the second portion preferably being integrally formed. To this end the second portion can, for example, be moulded on the first portion.

In order to ensure a good electrical shielding by means of the shielding sleeve, this sleeve preferably consists of a metal such as, for example, copper, or a metal alloy such as, for example, brass.

A simple pushing through of a cable through the first portion of the shielding sleeve is preferably enabled by the first opening and the third opening being circular and having substantially the same diameter. This diameter can be maximally selected with a substantially circular cylindrical shape of the first portion.

The second opening is preferably also circular and has a smaller diameter than the first opening and the third opening. This is achieved particularly preferably by at least a part of the second portion tapering conically towards the second opening. This enables a cable shield to slide over the second portion in an especially simple manner.

In principle, any angle between the first portion and the second portion can be selected. In order to enable the design of the cable connector as a commercially available angled cable connector, it is however preferable that the first portion is angled at 90 degrees relative to the second portion.

After the cable has been positioned in the shielding sleeve in such a manner that it no longer runs through the third opening, rather only through the first and the second opening, the second opening is no longer required for receiving the cable. Indeed, it weakens the shielding effect of the shielding sleeve. It is therefore preferred that the third opening is closed by a cover. The cover consists in particular of the same material as the first portion and the second portion of the shielding sleeve in order to ensure good electrical conductivity.

In order to enable a simple attachment of the cover after the bending of the cable, it is preferred that the cover is releasably and electrically conductively connected to the first portion by means of several latch elements.

It is further preferred that the cover has an extension which closes the slot-shaped opening at least partially. The extension secures the cover additionally in its position by engaging with the slot-shaped opening. Furthermore, the enclosure of the cable by the shielding sleeve, said enclosure being interrupted by the slot-shaped opening, is partially completed by the extension.

Wires of the cables are preferably arranged in the shielding sleeve, while a cable shield of the cable is arranged outside the shielding sleeve. This enables simple production of the cable connector, as the wires can be moved through the slot-shaped opening in a simple manner and with the cable shield arranged outside, a good connection of the shield composed of cable shield and shielding sleeve can be implemented.

In a second aspect, the invention relates to a method for producing the cable connector. In this method, a first end of the cable is firstly introduced through the third opening into the first portion of the shielding sleeve. The first end of the cable is subsequently guided out of the first portion of the shielding sleeve again through the first opening. The cable routing thus corresponds to the positioning of a cable in a shielding sleeve of a straight shielded plug. The cable is subsequently bent such that a part of the cable is moved through the slot-shaped opening into the second portion of the shielding sleeve. This leads to a second end of the cable protruding out of the second opening of the shielding sleeve. When the diameter of the second opening is smaller than the outer diameter of the cable, the cable can thus be securely clamped in the second opening.

When the second portion of the shielding sleeve is tapered in the region of the second opening such that the inner diameter of the second portion tapers towards the second opening, a conically widening region of a cable shield is preferably slid over the conical region of the second portion of the shielding sleeve. The cable shield thus covers the gap-shaped opening in the conical region, such that a full shielding is ensured there. Fastening of the cable shield to the shielding sleeve is possible, for example, by clamping, in particular by means of a snap ring, or by soldering.

In order to, on the one hand, ensure as complete an enclosure of the cable as possible and thus a good shielding, and on the other hand to also avoid an unintended movement of the cable out of the second portion of the shielding sleeve, the width of the slot-shaped opening is preferably smaller than the outer diameter of the cable. When moving the part of the cable through the slot-shaped opening, wires of the cables are then moved individually through the slot-shaped opening, in order to be able to nevertheless move the cable through the slot-shaped opening.

After the bending of the cable, the third opening is preferably closed by means of the cover in order to complete the shielding in the region of the third opening.

Contacts of the cables can be arranged in particular in an insulating body which is fastened on the first opening, for example by means of latching. The fastening can already be carried out before the introduction of the cable into the shielding sleeve, or only afterwards. However, it is preferably carried out before the bending of the cable.

EXEMPLARY EMBODIMENTS OF THE INVENTION

Figure 1:
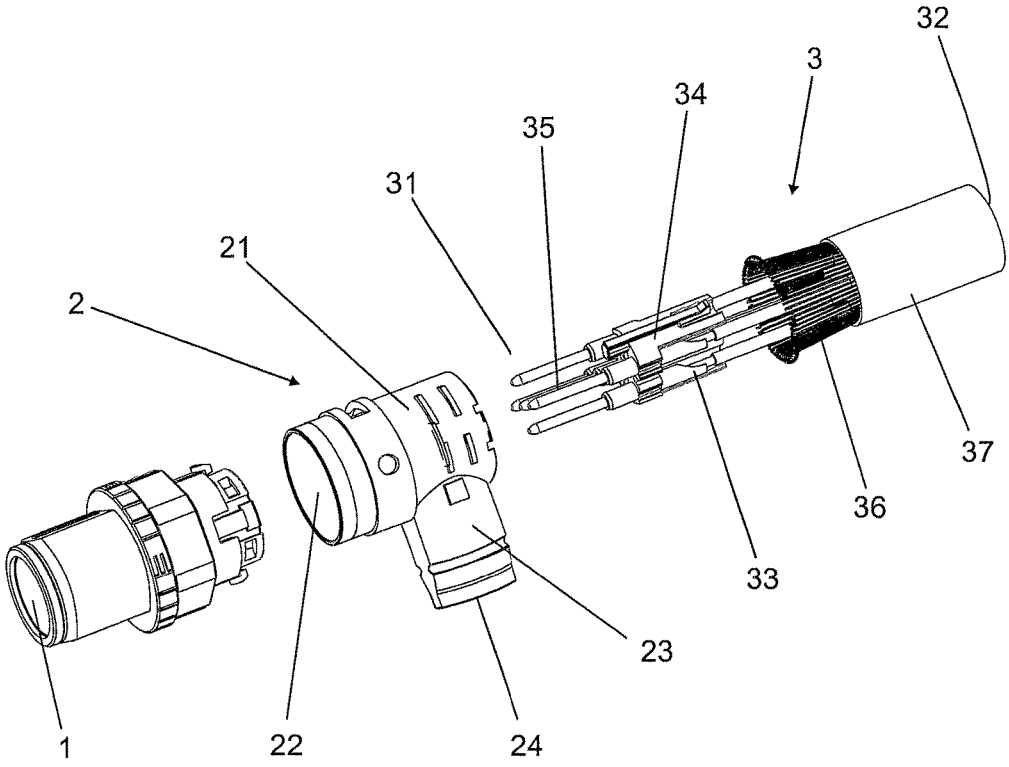
FIG. 1 shows an isometric view of several components of a cable connector according to an exemplary embodiment of the invention.

In order to receive a cable connector according to an exemplary embodiment of the invention, as shown in FIG. 1, a first insulating body 1, a shielding sleeve 2 and a cable 3 are provided. The shielding sleeve 2 has a circular cylindrically shaped first portion 21 in the shape of a pressure die cast part which is manufactured without cutting. This first portion 21 has a circular opening on both of its ends respectively. The first opening 22 faces the first insulating body 1. A second portion 23 of the shielding sleeve 2 has a circular cylindrical region which is moulded onto the shielding sleeve 2 at a right angle to the longitudinal axis of the first portion 21. In the moulding region, the wall of the first portion 21 is broken such that the interior of the first portion 21 is connected to the interior of the second portion 23. On its end facing away from the first portion 21, the second portion 23 has a conically tapering region which ends in a second opening 24. The diameter of this second opening 24 is smaller than the diameter of the first opening 22. The cable 3 has a first end 31 and a second end 32. It contains several wires 33, which are connected to contacts 35 which are soldered onto the wires 33 via a contact holder 34. The wires 33 are surrounded by a cable shield 36 which in turn surrounds a cable sheath 37.

Figure 2A:
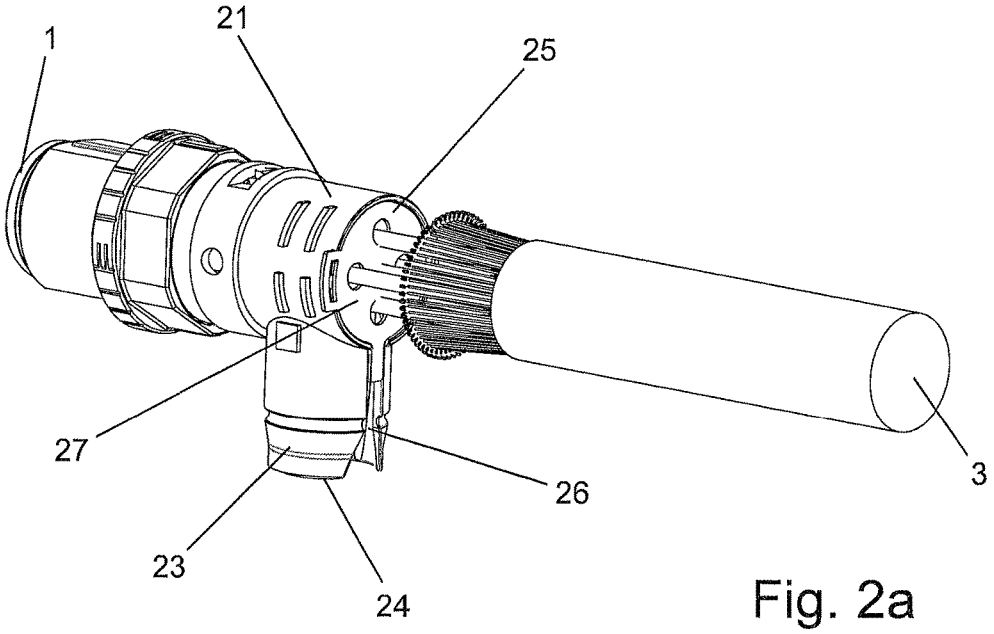
FIG. 2 shows an isometric view of the components of the cable connector according to the first exemplary embodiment of the invention in a partially assembled state.
FIG. 2*b* shows the components shown in FIG. 2*a* in a different isometric view.
Figure 2B:
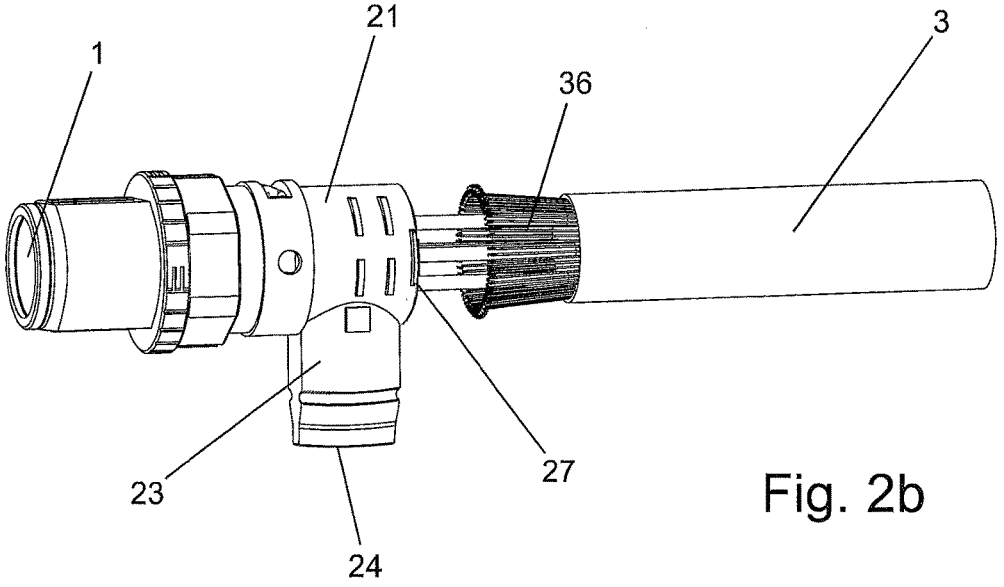

As shown in FIGS. 2*a* and 2*b*, the first insulating body 1 is fastened to the first opening 22 of the shielding sleeve 2 by latch elements, which are not shown, being latched to this. The first end 31 of the cable 3 is guided through the third opening 25 of the shielding sleeve 2, said third opening being opposite the first opening 22, through the first portion 21, and through the first opening 22 again out of this portion, so that the contacts 35 are arranged in the first insulating body 1. The second opening 24 is connected to the third opening 25 by means of a gap-shaped opening 26. The width of this gap-shaped opening 26 is narrower than the outer diameter of the cable 3 but wider than the outer diameter of the wires 33. The part of the cable 3 still located outside the shielding sleeve 2 is moved into the second portion 23 of the shielding sleeve 2 by the wires 33 being pressed successively through the gap-shaped opening 26.

Figure 3:
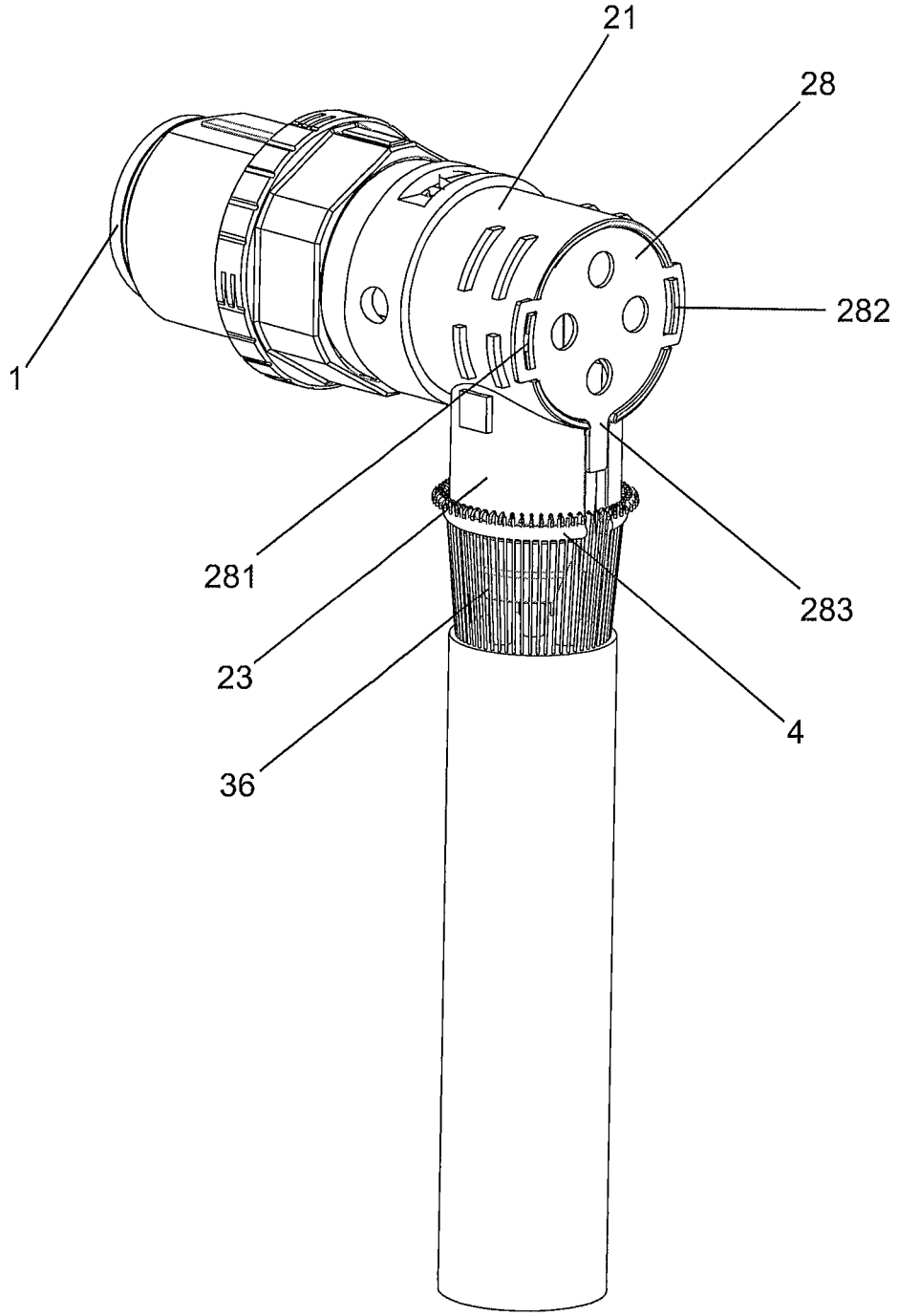
FIG. 3 shows an isometric view of the assembled components of the first exemplary embodiment of the invention, wherein an opening of a shielding sleeve is closed by a cover.

As shown in FIG. 3, the cable shield 36 of the cable 3 can now be slid over the conical region of the second portion 24 such that it closes the gap-shaped opening 26 in this region. It is fixed in its position by means of a snap ring 4.

The first portion 21 has two latch elements 27 which are opposite each other on the edge of the third opening 25. A cover 28, which also has latch elements 281, 282, is applied to the third opening 25 such that it closes this opening and that its latch elements 281, 282 latch with the latch elements 27 of the shielding sleeve 2 and fix the cover 28 in its position. The cover 28 furthermore has a web-shaped extension 283, which partially closes the region of the slot-shaped opening 27 which is not closed by the cable shield 36.

Figure 4A:
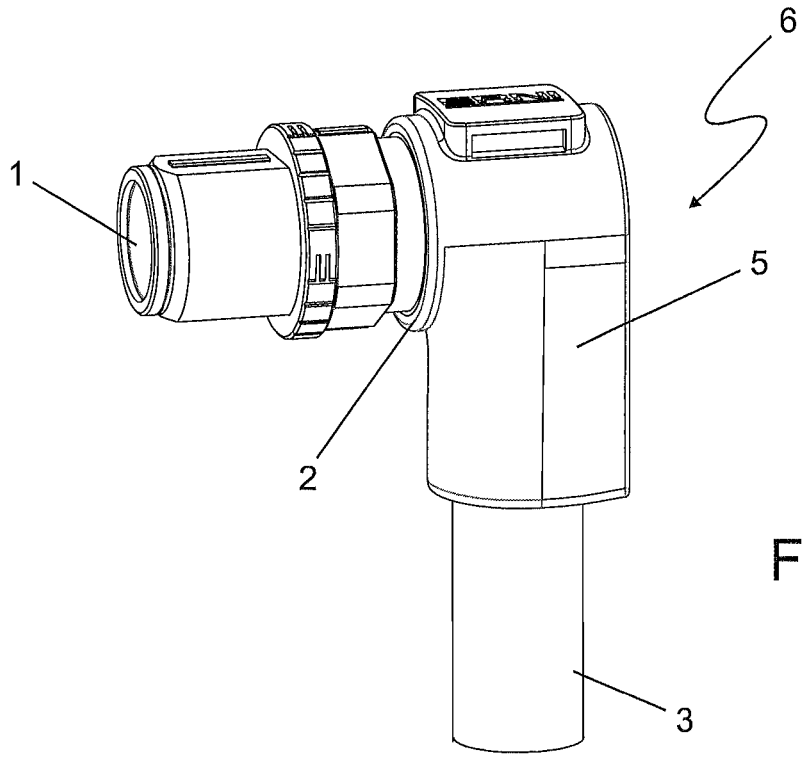
FIG. 4*a* shows a cable connector according to an exemplary embodiment of the invention in an isometric view.
Figure 4B:
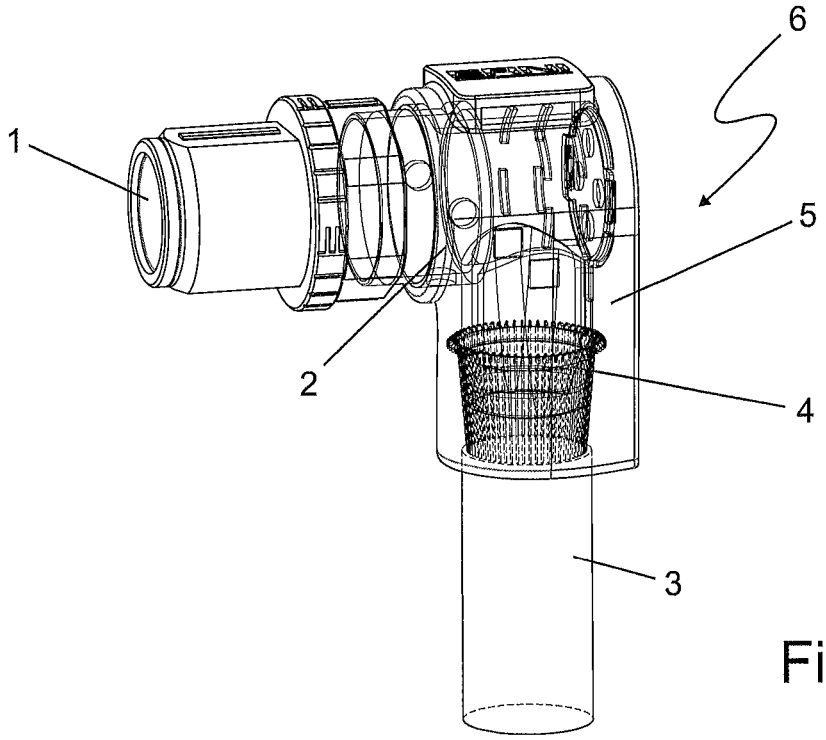
FIG. 4*b* shows a half-transparent isometric view of the cable connector according to FIG. 4*a*.

As shown in FIGS. 4*a* and 4*b*, the shielding sleeve 2 and the region of the cable shield 36 which is not surrounded by the cable sheath 37 are enclosed by injection moulding of a second insulating body 5 in order to finally receive the cable connector 6 shown.

The invention claimed is:

1. A cable connector, having a shielding sleeve, having a first portion with a first opening and a second portion with a second opening, which is angled with respect to the first portion, wherein the first portion has a third opening which is opposite the first opening on the longitudinal axis of the first portion, wherein the second portion has a slot-shaped opening which connects the second opening to the third opening, and a cable which is guided through the first opening and through the second opening of the shielding sleeve, wherein the third opening is closed by a cover, and wherein the cover is releasably and electrically conductively connected to the first portion by means of several latch elements.

2. The cable connector according to claim 1, wherein the first portion and the second portion are formed as one piece.

3. The cable connector according to claim 1, wherein the first portion is angled at 90° relative to the second portion.

4. The cable connector according to claim 1, wherein the cover has an extension which closes the slot-shaped opening at least partially.

5. The cable connector according to claim 1, wherein the first opening and the third opening are circular and have substantially the same diameter.

6. The cable connector according to claim 5, wherein the second opening is circular and has a smaller diameter than the first opening and the third opening.

7. The cable connector according to claim 6, wherein at least a part of the second portion tapers conically towards the second opening.

8. A method for producing the cable connector according to claim 1, the method comprising the following steps:

introducing a first end of the cable into the first portion of the shielding sleeve through the third opening, guiding the first end of the cable out of the first portion of the shielding sleeve through the first opening, bending the cable so that a part of the cable is moved through the slot-shaped opening into the second portion of the shielding sleeve and a second end of the cable protrudes out of the second opening of the shielding sleeve, and after bending the cable, closing the third opening by a cover releasably and electrically connected to the first portion by means of several latch elements.

9. The method according to claim 8, wherein wires of the cable are moved successively through the slot-shaped opening when the part of the cable is moved through the slot-shaped opening.

10. The method according to claim 8, wherein a conical portion of a cable shield is guided over the conical region of the second portion of the shielding sleeve, after the part of the cable has been moved into the second portion.

* * * * *